US010474105B2

(12) United States Patent
Charbon

(10) Patent No.: US 10,474,105 B2
(45) Date of Patent: Nov. 12, 2019

(54) ECONOMICAL TIMEPIECE DISPLAY COMPONENT

(71) Applicant: Nivarox-FAR S.A., Le Locle (CH)

(72) Inventor: Christian Charbon, Chezard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 291 days.

(21) Appl. No.: 15/455,614

(22) Filed: Mar. 10, 2017

(65) Prior Publication Data

US 2017/0261936 A1 Sep. 14, 2017

(30) Foreign Application Priority Data

Mar. 14, 2016 (EP) ..... 16160069

(51) Int. Cl.
*G04B 19/04* (2006.01)
*G04B 37/22* (2006.01)
(Continued)

(52) U.S. Cl.
CPC ..... *G04B 19/042* (2013.01); *G04B 19/10* (2013.01); *G04B 19/103* (2013.01); *G04B 19/12* (2013.01);
(Continued)

(58) Field of Classification Search
CPC ..... G04B 19/042; G04B 19/12; G04B 12/10; G04B 19/103; G04B 19/06; G04B 37/22; G04D 3/0079; G04D 3/00; B22F 2003/247
(Continued)

(56) References Cited

U.S. PATENT DOCUMENTS 3,724,202 A 4/1973 Feller
3,789,605 A * 2/1974 Kishida ..... G04B 37/22 368/280
(Continued)

FOREIGN PATENT DOCUMENTS

DE 2 034 006 A1 1/1972
FR 2 300 380 A1 9/1976
(Continued)

OTHER PUBLICATIONS

English Abstract: JP-58083289-A (Year: 1983).*
(Continued)

*Primary Examiner* — Jacob J Cigna
(74) *Attorney, Agent, or Firm* — Sughrue Mion, PLLC

(57) ABSTRACT

Economical method for manufacturing a timepiece display or hand-fitting component:

a casing material is chosen for each visible surface: amorphous metal or nanocrystalline alloy or alloy of gold and/or silver and/or copper and/or rhodium and/or titanium and/or aluminium;

a thick, hollow blank of a thickness greater than 20 micrometres is created in a first tool, from the casing material with an initial thickness greater than or equal to 50 micrometres, with an overthickness with respect to each visible surface, with a first cavity for reception of a support structure;

an interior material is chosen to make a support structure;

the support structure is made and joined to the first cavity;

one visible surface remaining visible, is diamond tool machined, removing all or part of the overthickness from the blank.

22 Claims, 3 Drawing Sheets

(51) Int. Cl.

| | |
|---|---|
| ***G04B 19/10*** | (2006.01) |
| ***G04D 3/00*** | (2006.01) |
| ***G04B 19/12*** | (2006.01) |
| ***G04B 19/06*** | (2006.01) |

(52) U.S. Cl.
CPC ..... *G04B 37/22* (2013.01); *G04D 3/00* (2013.01); *G04D 3/0074* (2013.01); *G04B 19/06* (2013.01)

(58) Field of Classification Search
USPC ..... 368/280; 968/143
See application file for complete search history.

(56) References Cited

U.S. PATENT DOCUMENTS

| | | | | |
|---|---|---|---|---|
| 3,989,603 | A * | 11/1976 | Montavon | B44C 1/22 205/121 |
| 4,404,067 | A * | 9/1983 | Enomoto | G04B 19/042 205/273 |
| 5,363,350 | A * | 11/1994 | Marr-Andre | G04B 37/0008 368/276 |
| 5,493,544 | A * | 2/1996 | Marthe | G04B 37/0008 368/278 |
| 7,121,717 | B2 * | 10/2006 | Grippo | C04B 41/009 368/280 |
| 8,999,217 | B2 * | 4/2015 | Winkler | B21J 1/006 264/264 |
| 9,194,052 | B2 * | 11/2015 | Fussinger | B81C 99/0085 |
| 9,550,325 | B2 * | 1/2017 | Sievers | B22F 3/1055 |
| 9,588,495 | B2 * | 3/2017 | Plankert | C04B 41/90 |
| 9,669,424 | B2 * | 6/2017 | Winkler | B21J 1/006 |
| 9,733,622 | B2 * | 8/2017 | Knuchel | G04D 3/0097 |
| 9,816,162 | B2 * | 11/2017 | Mikaki | C22C 29/16 |
| 9,958,834 | B2 * | 5/2018 | Knuchel | G04B 37/22 |
| 2002/0068148 | A1 | 6/2002 | Nakamura et al. | |
| 2004/0155384 | A1 * | 8/2004 | Sievers | B22F 3/1055 264/497 |
| 2005/0136284 | A1 * | 6/2005 | Grippo | C04B 41/009 428/688 |
| 2005/0208325 | A1 * | 9/2005 | Kawakami | A44C 27/006 428/660 |
| 2012/0042510 | A1 * | 2/2012 | Fussinger | B81C 99/0085 29/829 |
| 2014/0112112 | A1 * | 4/2014 | Plankert | C04B 41/90 368/276 |
| 2016/0208366 | A1 * | 7/2016 | Mikaki | C22C 29/16 |

FOREIGN PATENT DOCUMENTS

| | | | | |
|---|---|---|---|---|
| GB | 2 062 907 | A | 5/1981 | |
| JP | 58083289 | A * | 5/1983 | G04B 37/22 |

OTHER PUBLICATIONS

Anonymous, "diamantage pour des surfaces plus fins", Oct. 17, 2016, XP055311486, Extrait de I'Internet: URL:http://www.samuelwerder.ch/lexikon/intro/info.asp?IDWissen=5&userlang=FR.

N.N., "Dictionnaire professionel illustre de I'horlogerie—diamantage", Jan. 1, 2016, XP055311965, Extrait de I'Internet: URL:http://www.fhs.swiss/berner/?I=fr.

European Search Report of European Application No. 16 16 0069 dated Oct. 27, 2016.

* cited by examiner

ECONOMICAL TIMEPIECE DISPLAY COMPONENT

This application claims priority from European Patent Application No. 16160069.7 filed on Mar. 14, 2016, the entire disclosure of which is hereby incorporated herein by reference.

FIELD OF THE INVENTION

The invention concerns an economical method for manufacturing a timepiece display or hand-fitting component including at least one aesthetical and/or visible surface.

The invention also concerns a watch including at least one display or hand-fitting component made by this method.

The invention concerns the field of timepiece display or hand-fitting components.

BACKGROUND OF THE INVENTION

In horology, the manufacture of small display, hand-fitting or external components always poses practical problems of production, owing to the importance of these components in the aesthetical aspect of a watch and how it is evaluated by the client or user.

Indeed, the user's gaze is necessarily drawn to these components, which must therefore have a flawless appearance, a very fine but also very regular surface finish, and, generally, brightness and reflection qualities that are difficult to obtain in a reproducible manner. Indeed, components such as appliques are distributed in large numbers over the watch dial, and must be perfectly identical.

The production cost and the weight of these components must also be kept under control, especially when they are mobile, like hands. Consequently, convenient solutions consisting, in luxury horology, of machining the components in a precious alloy weight, like gold, are not always the most suitable.

It is also known that manufacturing such components with prior machining followed by a surface treatment generates a relatively high scrap rate, since the treatment reveals visual and/or surface defects that were not visible at the machining stage, and is therefore wasted, when it is expensive because of the desired finish.

DE Patent Application 2034006A1 in the name of MELTER & KUEHN discloses a method for producing markings on dials. The markings are formed in relief from the back to the front of the dial. The hollows in the back portion are filled with a visually contrasting filler material, such as paint, plastic, low-temperature molten metal, or similar. Then the protruding areas of the front portion are milled until the contrasting filler appears.

SUMMARY OF THE INVENTION

The invention proposes to develop an alternative method for producing, at controlled cost, timepiece display or hand-fitting components comprising at least one aesthetical and/or visible surface, while ensuring the visual and surface reproducibility of these visible surfaces, with improved reliability of production compared to the prior art.

To this end, the invention concerns a manufacturing method according to claim 1.

The invention also concerns a watch including at least one display or hand-fitting component made by this method.

BRIEF DESCRIPTION OF THE DRAWINGS

Other features and advantages of the invention will appear upon reading the following detailed description, with reference to the annexed drawings, in which:

FIG. 1 represents the manufacture, in a first tool, of a hollow blank of a certain thickness, made in a casing material.

FIG. 2 represents a variant wherein the first tool includes an inner peripheral contact layer, such as a metallized or similar layer, to permit manufacture of the blank by galvanic growth.

FIG. 3 represents the separate manufacture of a support structure by press-forming between a punch and a die.

FIG. 4 represents the joining of such a support structure to the blank of FIG. 1 which is still held inside its first tool.

FIG. 5 represents the free form manufacture of such a support structure.

FIG. 6 represents the manufacture by punching of such a support structure.

FIG. 7 represents the joining of a support structure as seen in FIG. 3 or 5 or 6, to the blank of FIG. 1 removed from its first tool.

FIG. 8 represents a variant wherein the support structure is fabricated directly inside a cavity comprised in the blank of FIG. 1.

FIG. 9 represents the diamond tool machining of the aesthetical and/or visible surfaces by removing an overthickness from the blank, which has been removed from its first tool and is already joined to a support structure comprising a mounting foot.

FIG. 10 represents the finished and ready-to-use component.

FIG. 11 represents a hollow hand, with transverse and longitudinal cross-sections in FIGS. 11A and 11B.

FIG. 12 represents an applique provided with two feet.

FIG. 13 represents a numeral provided with two feet.

FIG. 14 represents a symbol provided with two feet.

FIG. 15 represents a monogram provided with one foot.

FIG. 16 represents an indicator.

FIG. 17 represents an index provided with two feet.

FIG. 18 represents an aperture surround provided with four feet.

DETAILED DESCRIPTION OF PREFERRED EMBODIMENTS

Figure 1:
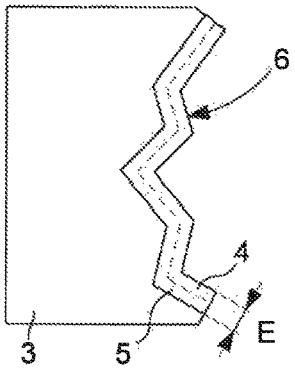
FIGS. 1 to 10 show schematic and cross-sectional views of different steps for implementation of the method according to the invention, in different alternatives.
Figure 2:
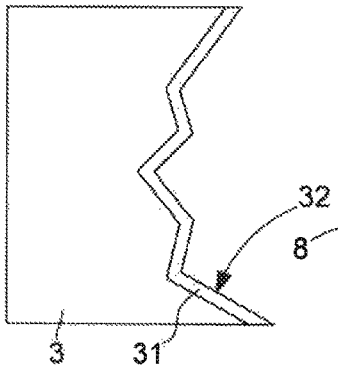

The invention proposes to reduce both the cost and the weight of external or hand-fitting components, while ensuring a flawless appearance for such visible components and reducing manufacturing scrap as far as possible.

The invention proposes to form a preferably hollow shell whose surface portion is made in a material compatible with finishing machining in order to obtain a regular surface finish with very low roughness.

This surface portion is formed in a thickness sufficient to ensure the homogeneity of the material, and thus to guarantee the final finish quality after machining.

The preferred finishing machining is diamond polishing with a tool.

The invention thus concerns an economical method for manufacturing a timepiece display or hand-fitting component 1, formed by a hand 11, an applique 12, or similar, comprising at least one aesthetical and/or visible surface 2 intended to be visible to the user of a watch or similar.

According to the invention, the following steps are performed in succession:

AA: there is chosen a casing material for making each aesthetical and/or visible surface 2, which is an amorphous metal alloy or has a nanocrystalline structure or includes nickel or nickel-phosphorus, or which is a pure metal or an alloy of gold and/or silver and/or copper and/or rhodium and/or titanium and/or aluminium.

BB: a thick hollow blank 4 of an initial thickness greater than or equal to 20 micrometres, formed in the casing material, is created in a first tool 3, blank 4 including an overthickness 5 with respect to the final level of each aesthetical and/or visible surface 2, and this blank 4 including a first cavity 6 for reception of a support structure 7. The notion of reception is meant in the broad sense here, since, depending on the embodiment variant, support structure 7 may be mounted inside cavity 6, or be linked to cavity 6 over all or part of the surface of cavity 6.

CC: there is chosen an interior material that is easy to shape by deformation, punching and/or press forming, and/or machining and/or injection and/or galvanic growth and/or casting, in order to make such a support structure 7. Since support structure 7 is not intended to be seen, the interior material can advantageously be an inexpensive material, and preferably of lower or equal cost to that of the casing material.

DD: support structure 7 is made in the interior material, by punching and/or press forming and/or machining and/or injection and/or galvanic growth and/or casting, in a second tool 8 or directly inside first cavity 6 or in free form, and support structure 7 is joined to first cavity 6 of blank 4.

EE: at least one such aesthetical and/or visible surface 2 which is intended to remain visible, is diamond tool machined, removing all or part of overthickness 5 from blank 4. More particularly, overthickness 5 is entirely removed over the aesthetical and/or visible surface 2 concerned, during this first diamond machining operation, which may also be the only operation, depending on the appearance desired for the finished component 1.

The method according to the invention can be implemented with a first reusable tool 3, such as a mould or similar, or with a first disposable tool 3, such as a shell made of light material, polymer, such as PMMA, or other, which is in turn manufactured using another tool. Consequently, once blank 4 is completely formed, one can choose either to leave it in first tool 3 for at least part of the following operations, or to remove it.

When first tool 3 includes a peripheral contact layer 31, for example a metallized layer (by PVD or equivalent) to permit galvanic growth of blank 4, this peripheral contact layer 31 can be either kept or removed for the subsequent operations. It may, in particular, remain at the surface of overthickness 5 and be machined therewith during the diamond tool machining operation.

In a preferred implementation of the invention, blank 4 is made in the casing material with an initial thickness E greater than or equal to 50 micrometres.

In a particular implementation of the invention, component 1 is made with at least one aesthetical and/or visible surface 2 bordered by a protruding edge 9, and, during diamond tool machining, protruding edge 9 is made and delimits aesthetical and/or visible surface 2.

In a particular implementation of the invention, during the diamond tool machining operation, all the aesthetical and/or visible surfaces 2 intended to remain visible are diamond tool machined, removing all or part of overthickness 5, and, if comprised in component 1, all the protruding edges 9 which delimit aesthetical and/or visible surfaces 2. Preferably, overthickness 5 is removed in its entirety during this diamond tool machining operation. In another variant, the removal of overthickness 5 is completed during a further diamond tool machining operation, which may be required due to a particular geometry of component 1.

In a particular implementation of the invention, during the diamond tool machining operation, at least one such aesthetical and/or visible surface 2 intended to remain visible is diamond tool machined, removing all or part of overthickness 5, with a surface condition comprised between 2 nm Ra and 100 nm Ra.

In a particular implementation of the invention, during the diamond tool machining operation, a residual thickness ER of at least 5 micrometres of blank 4 is kept, on each aesthetical and/or visible surface 2.

In a particular implementation of the invention, during the diamond tool machining operation, at least 50% of initial thickness E is removed from blank 4.

In a particular implementation of the invention, a galvanic or PVD or CVD or ALD or chemical colouring operation is performed to a thickness of less than 5 micrometres, on at least one of the aesthetical and/or visible surfaces 2 intended to remain visible, after the diamond tool machining operation. More particularly, such a colouring operation is performed over all the aesthetical and/or visible surfaces 2.

In a particular implementation of the invention, the interior material is chosen from among alloys of copper and/or aluminium and/or zinc.

In a particular implementation of the invention, brass is chosen for the interior material.

In a particular implementation of the invention, an aluminium alloy is chosen for the interior material.

In a particular implementation of the invention, a zinc alloy is chosen for the interior material.

In a particular implementation of the invention, a POM or PS or PC or polymer is chosen for the interior material.

In a particular implementation of the invention, a charged material is chosen for the interior material to make it electrically conductive.

In a particular implementation of the invention, the casing material is chosen as the interior material. It is thus possible to make a component 1, particularly a hollow component 1 with a second cavity 70, in a single material. More particularly, blank 4 can be made by galvanic growth, for example in Ni—P, and support structure 7 by continuing the Ni—P growth; the electrical parameters could however be modified to save time in the manufacturing cycle, since support structure 7 is not required to have grain fineness or be free of defects, the only function of support structure 7 being the mechanical holding of component 1.

In a particular implementation of the invention, the casing material is chosen to be different from the interior material.

In a particular implementation of the invention, nickel-phosphorus is chosen for the interior material.

In a particular implementation of the invention, support structure 7 is bonded inside first cavity 6 of blank 4.

In a particular implementation of the invention, support structure 7 is inserted and held by deformation inside first cavity 6 of blank 4, held inside first tool 3.

Figure 3:
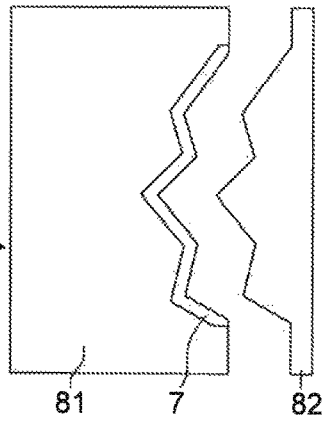
Figure 4:
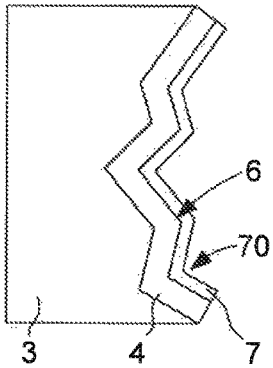
Figure 5:
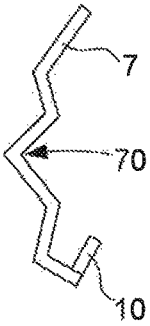
Figure 6:
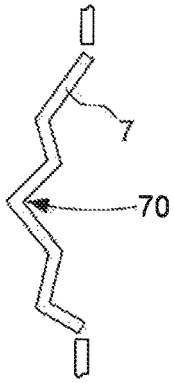
Figure 7:
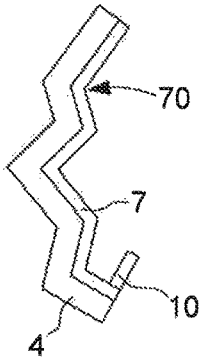
Figure 8:
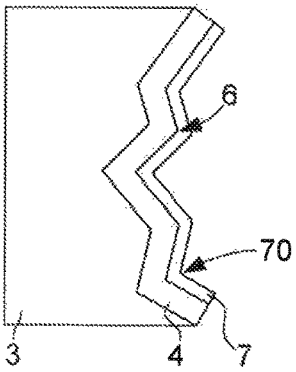
Figure 9:
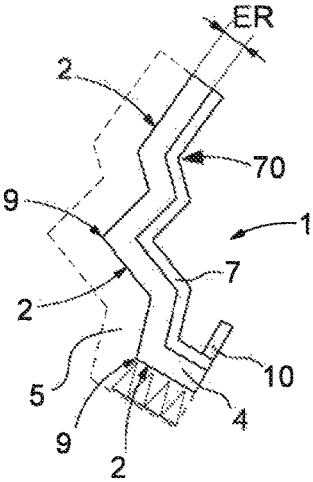
Figure 10:
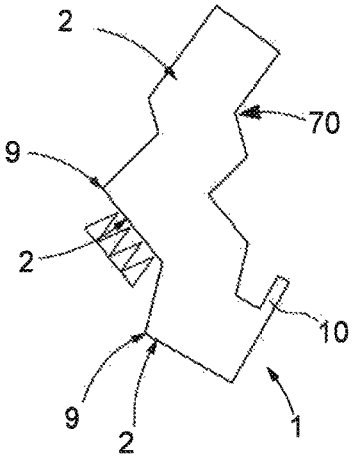
Figure 11:
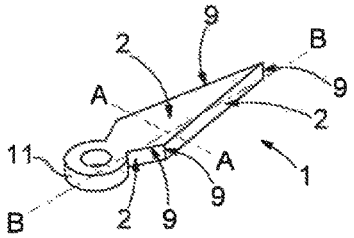
FIGS. 11 to 18 show schematic, perspective views of non-limiting implementation examples of the invention.
Figure 11A:
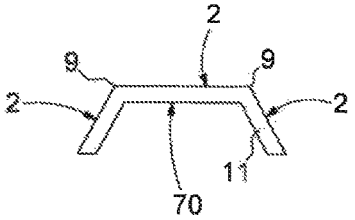
Figure 11B:
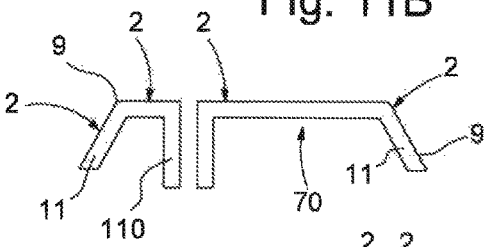
Figure 12:
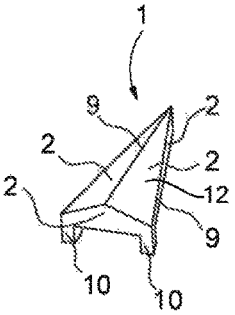
Figure 13:
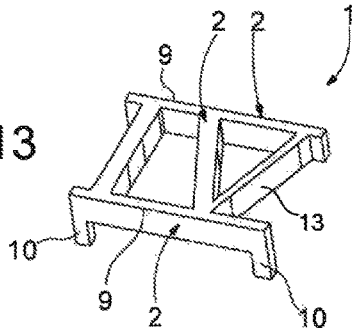
Figure 14:
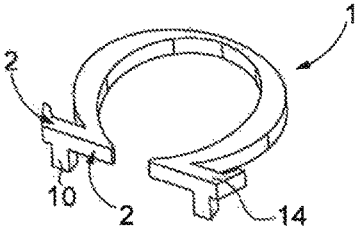
Figure 15:
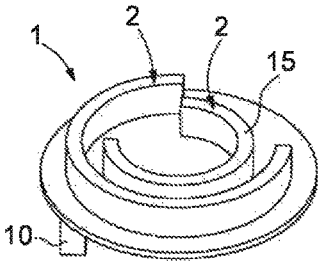
Figure 16:
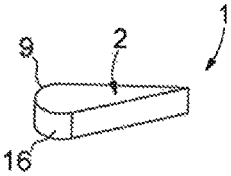
Figure 17:
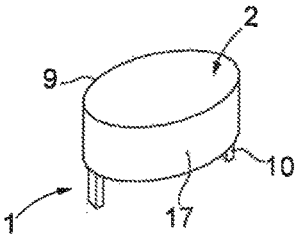
Figure 18:
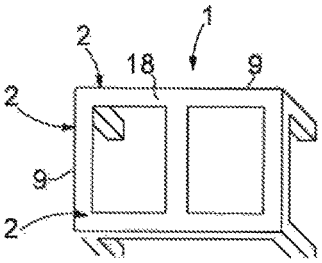
Figure 19:
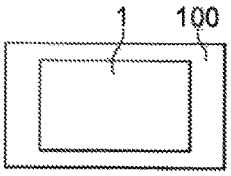
FIG. 19 is a block diagram featuring a watch comprising a component made by the method according to the invention.
Figure 20:
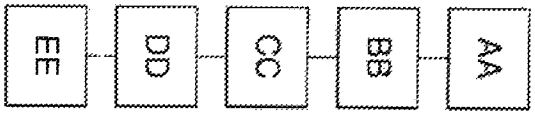
FIG. 20 is a block diagram figuring the steps of the method according to the invention.

In a particular implementation of the invention, support structure 7 is made by press forming between a punch 82 and a die 81 together forming a second tool 8, as seen in FIG. 3.

In a particular and advantageous implementation of the invention, support structure 7 is made hollow, with a second cavity 70 and/or including at least one mounting foot 10. Component 1 therefore has a particularly low weight, offers a finished surface condition which is flawless, and is ready to be assembled in a watch 100 or similar.

In a particular implementation of the invention, component 1 is made in the form of a hand 11 or an applique 12 or a numeral 13 or a symbol 14 or a monogram 15 or an indicator 16 or an index 17 or an aperture surround 18, or other similar component.

It is advantageous to make component 1 hollow, in particular in the case of a hand 11 represented here with a pipe 110, thereby minimising the unbalance.

Naturally, although a single support structure with a single blank is shown, the invention can also be implemented with a single blank and several support structures, or several blanks and a single support structure, or even several blanks and several support structures, for a single component.

The invention also concerns a watch 100 including at least one display or hand-fitting component 1 made by the method according to the invention.

The diamond tool machined finish of such a component is distinguished by the perfect quality of its surface condition (mirror) and by the intersection of the sides which define sharp edges, which cannot be ensured by any other manufacturing method.

What is claimed is:

1. A method of manufacturing a timepiece display or hand-fitting component including at least one aesthetical and/or visible surface, the method comprising:

selecting a casing material to make each said aesthetical and/or visible surface, said casing material comprising nickel-phosphorous;

obtaining a first tool having a surface, said surface having a shape corresponding to said at least one aesthetical and/or visible surface;

creating a hollow blank formed of said casing material on said surface of said first tool, said hollow blank having a thickness greater than or equal to 50 micrometres, and said hollow blank including a first cavity for reception of a support structure;

selecting an interior material capable of being shaped by deformation, punching and/or press forming, and/or machining and/or injection and/or galvanic growth and/or casting;

creating said support structure made of said interior material by punching and/or press forming and/or machining and/or injection and/or galvanic growth and/or casting, using a second tool or directly inside said first cavity or in free form, and said support structure is joined to said first cavity of said blank; and machining, using a diamond tool, at least one said aesthetical and/or visible surface which is intended to remain visible, said machining removing casing material from the hollow blank in a thickness direction, wherein, after said machining, the thickness of said hollow blank is greater than or equal to 20 micrometres, and a surface roughness of said at least one said aesthetical and/or visible surface which is intended to remain visible is between 2 nm Ra and 100 nm Ra.

2. The method according to claim 1, wherein, during said machining, a residual thickness greater than or equal to 5 micrometres of said hollow blank is kept, on each said aesthetical and/or visible surface.

3. The method according to claim 1, wherein, during said machining, at least 50% of the thickness is removed from said hollow blank.

4. The method according to claim 1, wherein a galvanic or PVD or CVD or ALD or chemical colouring operation is performed to a small thickness of less than 5 micrometres, on at least one of said aesthetical and/or visible surfaces intended to remain visible, after the machining.

5. The method according to claim 1, wherein said casing material is chosen as the interior material.

6. The method according to claim 1, wherein said casing material is chosen to be different from the interior material.

7. The method according to claim 1, wherein said support structure is bonded inside said first cavity of said blank.

8. The method according to claim 1, wherein said support structure is inserted and held by deformation inside said first cavity of said blank held inside said first tool.

9. The method according to claim 1, wherein said support structure is made by deformation.

10. The method according to claim 1, wherein said support structure is made hollow with a second cavity and/or including at least one mounting foot.

11. The method according to claim 1, wherein said component is made in the form of a hand or an applique or a numeral or a symbol or a monogram or an indicator or an index or an aperture surround.

12. The method according to claim 1, wherein said interior material is nickel-phosphorous, and said hollow blank and said support structure are created in a single step of nickel-phosphorous galvanic growth.

13. The method according to claim 1, wherein said timepiece display or hand-fitting component is made with at least one said aesthetical and/or visible surface bordered by a protruding edge, wherein, said protruding edge, which delimits said aesthetical and/or visible surface, is made during said machining.

14. The method according to claim 13, wherein, during said machining, all the aesthetical and/or visible surfaces intended to remain visible are diamond tool machined, removing a part of said overthickness from said blank, and, if comprised in said component, all the protruding edges which delimit said aesthetical and/or visible surfaces.

15. The method according to claim 1, wherein a POM or PS or PC or a polymer is chosen for said interior material.

16. The method according to claim 15, wherein a charged material is chosen for said interior material to make the component electrically conductive.

17. The method according to claim 1, wherein said interior material is nickel-phosphorous, said hollow blank is created by galvanic growth having first electrical parameters, said support structure is created by galvanic growth having second electrical parameters, and the second electrical parameters are set to be different from the first electrical parameters.

18. The method according to claim 17, wherein an average grain size of the hollow blank is finer than an average grain size of the support structure.

19. The method according to claim 1, wherein said interior material is chosen from among alloys of copper and/or aluminium and/or zinc.

20. The method according to claim 19, wherein brass is chosen for said interior material.

21. The method according to claim 19, wherein an aluminium alloy is chosen for said interior material.

22. The method according to claim 19, wherein a zinc alloy is chosen for said interior material.

* * * * *